US008045739B2

(12) United States Patent
Paludan-Mueller et al.

(10) Patent No.: US 8,045,739 B2
(45) Date of Patent: Oct. 25, 2011

(54) METHOD AND APPARATUS FOR CONTROLLING BAND SPLIT COMPRESSORS IN A HEARING AID

(75) Inventors: Carsten Paludan-Mueller, Olystykke (DK); Carl Ludvigsen, Valby (DK); Anne Vikar Damsgaard, Stenlose (DK)

(73) Assignee: Widex A/S, Lynge (DK)

( * ) Notice: Subject to any disclaimer, the term of this patent is extended or adjusted under 35 U.S.C. 154(b) by 909 days.

(21) Appl. No.: 12/040,228

(22) Filed: Feb. 29, 2008

(65) Prior Publication Data

US 2008/0144869 A1 Jun. 19, 2008

Related U.S. Application Data

(63) Continuation-in-part of application No. PCT/EP2005/054311, filed on Sep. 1, 2005.

(51) Int. Cl.
*H04R 25/00* (2006.01)

(52) U.S. Cl. ..... 381/321; 381/106; 381/320

(58) Field of Classification Search ..... 381/104, 381/106, 107, 312, 314, 320, 321, 98; 704/225, 704/500

See application file for complete search history.

(56) References Cited

U.S. PATENT DOCUMENTS

| | | | | |
|---|---|---|---|---|
| 4,882,762 | A * | 11/1989 | Waldhauer | 381/106 |
| 5,832,097 | A * | 11/1998 | Armstrong et al. | 381/321 |
| 6,236,731 | B1 | 5/2001 | Brennan | |
| 6,732,073 | B1 | 5/2004 | Kluender | |
| 6,873,709 | B2 | 3/2005 | Hou | |
| 7,305,100 | B2 * | 12/2007 | Pedersen | 381/320 |
| 2002/0015503 | A1 | 2/2002 | Hou | |
| 2005/0141737 | A1 | 6/2005 | Hansen | |

* cited by examiner

*Primary Examiner* — Huyen D Le
(74) *Attorney, Agent, or Firm* — Sughrue Mion, PLLC

(57) ABSTRACT

In a method and hearing aid (200) for processing sound signals for hearing impaired persons by providing multi-band compression processing an input sound signal is filtered by a band split filter (202) into a number of frequency bands to obtain band split signals. A signal level for each of the band split signals is determined and the frequency bands are arranged into a number of groups. Based on the signal levels in each of the groups, a compressor input level for a number of band split compressors each associated to one of the frequency bands is calculated. A compressor gain for each band split compressor is determined based on the corresponding compressor input signal and the band split signals are amplified with the corresponding compressor gain and summed in a summing unit (208) to produce an output sound signal.

20 Claims, 7 Drawing Sheets

200

400

METHOD AND APPARATUS FOR CONTROLLING BAND SPLIT COMPRESSORS IN A HEARING AID

RELATED APPLICATIONS

The present application is a continuation-in-part of application No. PCT/EP2005/054311; filed on 1 Sep. 2005, in Denmark and published as WO2007025569, the contents of which are incorporated hereinto by reference.

BACKGROUND OF THE INVENTION

1. Field of the Invention

The present invention relates to hearing aids and methods of processing sound signals in hearing aids. The invention further relates to controlling sound signals and, more particularly, to methods and hearing aid devices that process sound signals, in particular for hearing impaired persons by controlling input levels of band split compressors in a hearing aid.

2. The Prior Art

Hearing loss of a hearing impaired person is quite often frequency-dependent. This means that the hearing loss of the person varies depending on the frequency. Therefore, when compensating for hearing losses, it can be advantageous to utilise frequency-dependent amplification and compression in a wide dynamic range. Hearing aids therefore often provide to split an input sound signal, and especially speech signals received by an input transducer of the hearing aid, into various frequency intervals, which are also called frequency bands. In this way it is possible to adjust the input sound signal of each frequency band individually depending on the hearing loss in that frequency band. The frequency dependent adjustment is normally done by implementing a band split filter and a compressor for each of the frequency bands, so-called band split compressors, which may be summarized to a multi-band compressor. In this way it is possible to adjust the gain individually in each frequency band depending on the hearing loss as well as the input level of the input sound signal in a respective frequency band. For example, a band split compressor may provide a higher gain for a soft sound than for a loud sound in its frequency band.

In order to adjust the hearing loss of a person by frequency, it is advantageous to split the signal into a large number of frequency bands. However, when using frequency-dependent amplification and compression, care must be taken to avoid unnecessary distortions often associated with multi-band non-linear processing. A particular problem of frequency-dependent amplification and compression is the so-called spectral smearing which may cause a loss of speech intelligibility since, e.g., the spectral differences in the speech spectrum are smeared or smoothed out due to the individual gain adjustments of the various band split compressors. A way to cope with this problem would be to reduce the number of frequency bands, however, this carries a disadvantage since it will then not be possible to provide a detailed frequency-dependent compensation of a hearing loss of a hearing impaired person.

U.S. Pat. No. 6,873,709 describes hearing aid devices that provide improved filtering and compression of sound signals. The described method and apparatus attempt to achieve a better speech audibility and intelligibility at low levels and also to pre-serve spectrum contrast at high levels by constraining the gain amount for each of the frequency bands against gain amounts associated with at least one neighbouring frequency band based on the corresponding estimated signal levels. As a result, the input sound signals will not be amplified by the gain amount adjusted by the compressors but with a constrained gain amount. This means that at first each band split compressor controls the actual initial gain in the respective frequency band based on the estimated signal level in this frequency band. After the gain adjustment by each individual compressor the initial gain amounts are constrained by a succeeding gain constraint unit if the initial gain amount exceeds a certain threshold level. Nevertheless, there remain disadvantages with speech audibility and intelligibility since the subsequent constraining of the individual initial gain amounts cannot really cope with the spectral smearing associated with the multi-band non-linear processing in the individual band split compressors. The restricted capability of constraining the initial gain amounts becomes even more apparent by the fact that a gain amount is constrained only if the signal level in the frequency band exceeds the threshold level since by this a spectrum contrast only with respect to higher signal levels will be preserved. The implementation of a gain constrained unit therefore may not cope with spectral smearing in all cases.

Thus, there is a need for improved techniques for providing multi-band compression processing of sound signals.

SUMMARY OF THE INVENTION

It is therefore an object of the present invention to provide a method and hearing aid for processing sound signals by band split compressors having improved gain control properties.

The present invention relates to improved approaches to filter input sound signals into a number of frequency bands to obtain band split signals and to compress the band split signals for hearing impaired persons in a hearing aid so as to achieve not only speech audibility and intelligibility but also to reduce spectral smearing in the output sound signal.

The invention in a first aspect, provides a method for processing sound signals in a hearing aid, said method comprising:

a) filtering an input sound signal into a number of frequency bands to obtain band split signal;
b) estimating a signal level for each of the band split signals;
c) arranging the frequency bands in at least two groups, wherein at least one group comprises signal levels of at least two frequency bands;
d) calculating a compressor input level for each band split signal, wherein the compressor input level for a respective band split signal is calculated based on the signal levels of the frequency bands of the group associated with said respective band split signal;
e) Determining a compressor gain for each band split signal based on the respective compressor input level; and
f) amplifying each band split signal with the determined compressor gain for said respective band split signal.

The present invention, in a second aspect, provides a hearing aid, comprising: an input transducer which is configured to transform an acoustic input sound signal into an electric input sound signal; a band split filter unit which is configured to filter the electric input sound signal into a number of frequency bands thereby obtaining a set of band split signals; a signal level estimation unit which is configured to determine a signal level for each of the band split signals; a grouping control unit which is configured to allocate the frequency bands into at least two groups, wherein at least one group comprises signal levels of at least two frequency bands, and to calculate a compressor input parameter for each band split compressor, wherein the compressor input parameter for at respective band split compressor is calculated based on the signal levels of the frequency bands of the group associated with said band split compressor; a band split compressor for each frequency band which is configured to determine a compressor gain based on the corresponding compressor input parameter, and to amplify each of the band split signals according to the compressor gain determined by the respective band split compressor; a summing unit which is configured to sum the amplified band split signals to an electric output signal; and an output transducer which is configured to transform the electric output signal into an acoustic output signal.

With the method and hearing aid according to the present invention it is possible to arrange the frequency bands into groups which means that the signal levels determined from the band split signals in each frequency band are grouped and the signal levels in each group are then used to calculate a compressor input level for each of the band split compressors, the band split compressors being used to determine or calculate a compressor gain for each band split signals. The input level for each band split compressor is thus calculated on the basis of the signal level in the respective frequency band as well as on the calculation result taking all signal levels in the group into account. Since not only the signal level of the respective frequency band but also other signal levels are taken into account when calculating the input level, spectral smearing can be avoided even if the input sound signal is split into a large number of frequency bands.

An advantage with respect to prior art technique may be seen by the fact that the actual signal level of a frequency band is still considered when calculating the compressor input level for this frequency band when determining the compressor gain without any succeeding constraining on the gain adjustment but also considering the signal levels of further frequency bands when determining the compressor input level.

According to an aspect of the present invention, the arrangement of the groups depends on and is set according to the nature of the input sound signal and/or the degree of hearing loss of the impaired person. Each group may comprise, besides the frequency band of the respective band split compressor, at least one neighbouring frequency band. The neighbouring frequency band is either an adjacent frequency band or at least one lower or higher frequency band that is in proximity to the frequency band of the respective band split compressor.

According to another aspect of the present invention, the compressor input level for each respective band split compressor is calculated by weighting a determined or estimated signal level in the group. Weighting could, e.g., mean that the signal level of the respective frequency band is weighted by a higher factor than for example the signal level of an adjacent frequency band which again is weighted by a higher factor than another signal level of the group which is not adjacent to the frequency band of the band split compressor.

According to another aspect of the present invention, the input level for each of the band split compressors is calculated by applying a mathematical function to the signal levels of the group. The mathematical function is a function which as an output generates the compressor input level out of the signal levels of the group. According to an embodiment, the mathematical function is a max function which sets the output to that signal level of the group which has the maximum value. In other words, all the input levels calculated for that group of frequency bands will be set to the maximum level of the signal levels in the group, and then an individual gain will be assigned to each frequency band by the respective band split compressor according to the input level. In this way, smearing is avoided since individual gains for the single frequency bands will not be increased, respectively decreased, independently. According to further embodiments, other mathematical functions like a min or a mean function are implemented according to the present invention.

According to yet another aspect of the present invention, the method and hearing aid provides a grouping template to arrange a frequency band into one or more groups and a decision rule for each group. The grouping template, according to an embodiment, may be a number defining how many frequency bands are arranged in a group, or a function defining which frequency bands are grouped together. For example, the grouping template may be equal to 3 starting from the highest or lowest frequency band so that every three neighbouring frequency bands are arranged into a respective group. Of course, the last group may then contain only one or two frequency bands depending on the overall number of frequency bands.

According to an aspect of the present invention, the decision rule for each group is the mathematical function as explained above which is applied to the signal levels of the frequency bands belonging to the group of the frequency band of the corresponding band split compressor.

According to another aspect of the present invention, the nature of the input sound is determined by classifying the input sound signals into sound classes and then providing the grouping template and/or the decision rule according to the determined sound class. In this way an adaptive grouping and input level calculation are provided which means that the selected grouping template and decision rule are optimised to the incoming sound giving the optimum result for the hearing aid user. For example, for speech and music signals more groups may be an advantage for assuring audibility in all frequency bands. On the other hand, for noise signals fewer groups are sufficient, since there is no need for audibility and, e.g., fewer groups combined with a max function as decision rule will result in giving the feeling of an overall noise reduction and thus a better comfort for the hearing aid user.

According to yet another aspect of the present invention, the degree of hearing loss is also taken into account by the method and hearing aid according to the present invention. According to an embodiment, the degree of hearing loss is provided or determined and then classified into hearing loss classes so that for a certain hearing loss class a grouping template and/or a decision rule is provided. For example, the more sloping the hearing loss is, the more groups are needed to get a satisfying gain adjustment. For mild hearing losses fewer groups are needed to get a satisfying gain.

According to another aspect of the present invention, the grouping and/or the selection of the decision rule is made adaptive and optimised to the incoming sound. In this way the best grouping and/or decision rule are always selected, giving the optimum result for the hearing aid user.

Further specific variations of the invention are defined by the further dependent claims.

Other aspects and advantages of the present invention will become more apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

Figure 1:
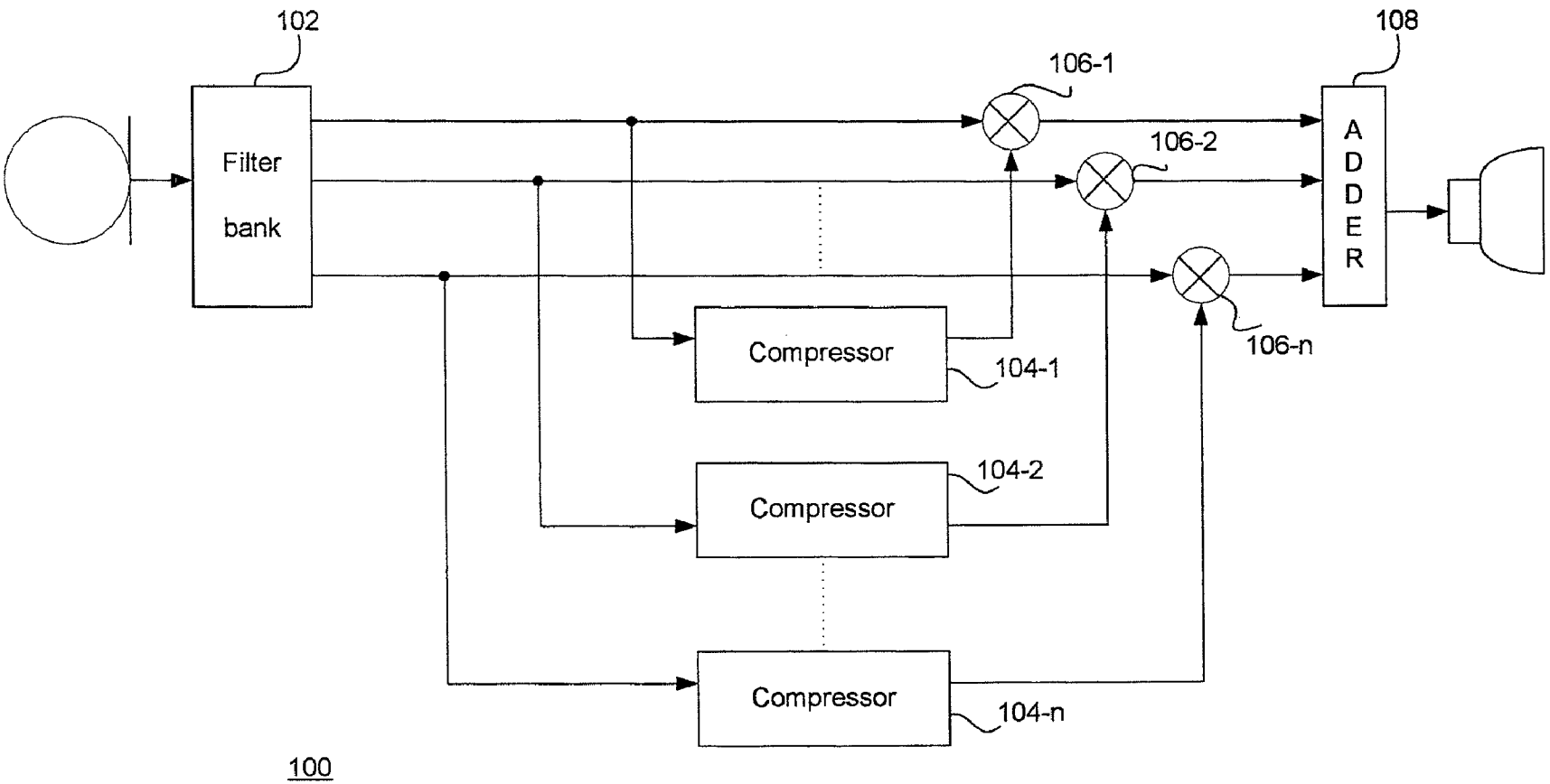
FIG. 1 is a block diagram of a multi-band compression processing system according to the prior art.

FIG. 1 is a block diagram of a conventional multi-band compression processing system 100. The system 100 includes a filter bank 102 that separates an incoming sound signal into different frequency bands. The individual band split signals for the frequency bands are then supplied to band split compressors 104-1, 104-2, . . . , **104-*n*. The compressors 104 amplify the level of the band split signals and then supply the amplified signals to multipliers 106-1, 106-2, . . . , 106-*n*. The multipliers 106 amplify or attenuate the sound signals for the particular frequency bands in accordance with the amplified signal levels to produce amplified sound signals. An adder 108** sums the amplified sound signals to produce an output sound signal.

Figure 2:
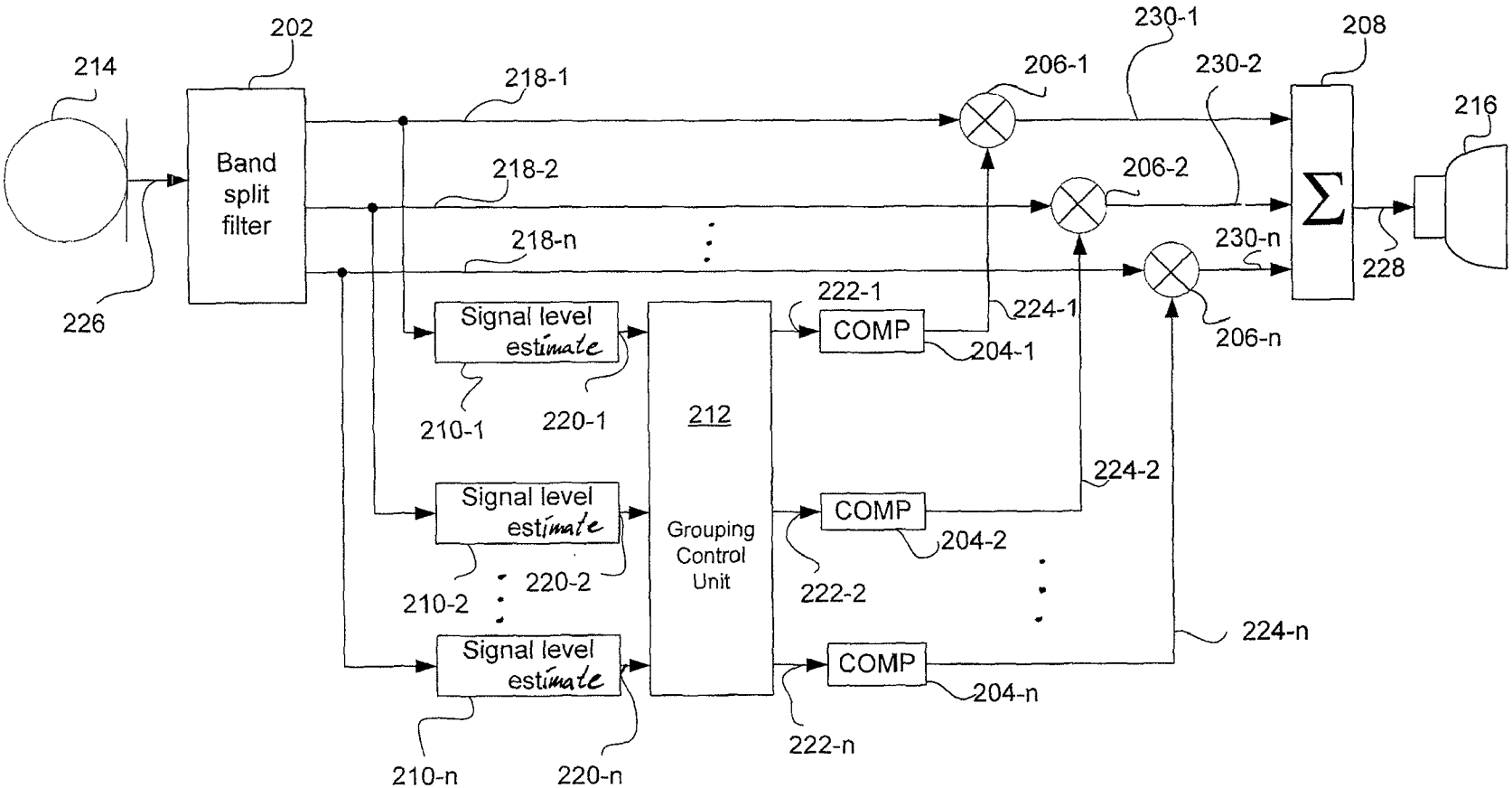
FIG. 2 is a block diagram of a hearing aid according to one embodiment of the present invention.

FIG. 2 shows a block diagram of a first embodiment of a hearing aid according to the present invention. The signal path of the hearing aid 200 comprises an input transducer or microphone 214 transforming an acoustic input sound signal into an electric input sound signal 226, a band split filter 202 receiving the electric input sound signal and splitting this electric input sound signal into a number of frequency bands to obtain band split signals 218-1, 218-2, . . . , **218-*n***, a summing unit and an output transducer.

The individual band split signals are supplied to the signal level estimation units 210-1, 210-2, . . . , **210-*n* for estimating the signal level for each of the band split signals. The individual signal levels 220-1, 220-2, . . . , 220-*n* are then supplied to a grouping control unit 212 to determine or calculate a compressor input level for each of a band split compressor 204-1, 204-2, . . . , 204-*n* for each of the frequency bands. The compressor input levels are referred to by reference signs 222-1, 222-2, . . . 222-*n* in FIG. 2. To calculate the compressor input levels 222-1, 222-2, . . . , 222-*n* for each band split compressor, the grouping control unit 212 arranges the signal levels 220-1, 220-2, . . . , 220-*n* into groups such that for each band split compressor a group of frequency bands is determined and the compressor input level for this band split compressor is calculated based on the signal levels in that group. Each band split compressor then determines an individual gain based on its compressor input level. The individual compressor gains produced by the band split processors are referred to by reference signs 224-1, 224-2, . . . , 224-*n* in FIG. 2. Multipliers 206-1, 206-2, . . . , 206-*n* are provided in the signal path for each of the frequency bands to amplify each band split signal 218-1, 218-2, . . . , 218-*n* with its corresponding compressor gain 224-1, 224-2, . . . , 224-*n* to produce amplified band split signals 230-1, 230-2, . . . , 230-*n*. The summing unit 208 then sums the amplified band split signals to produce and electric sound output signal 228 which may then be trans-formed by the output transducer 216** into an acoustic sound output signal.

Figure 3:
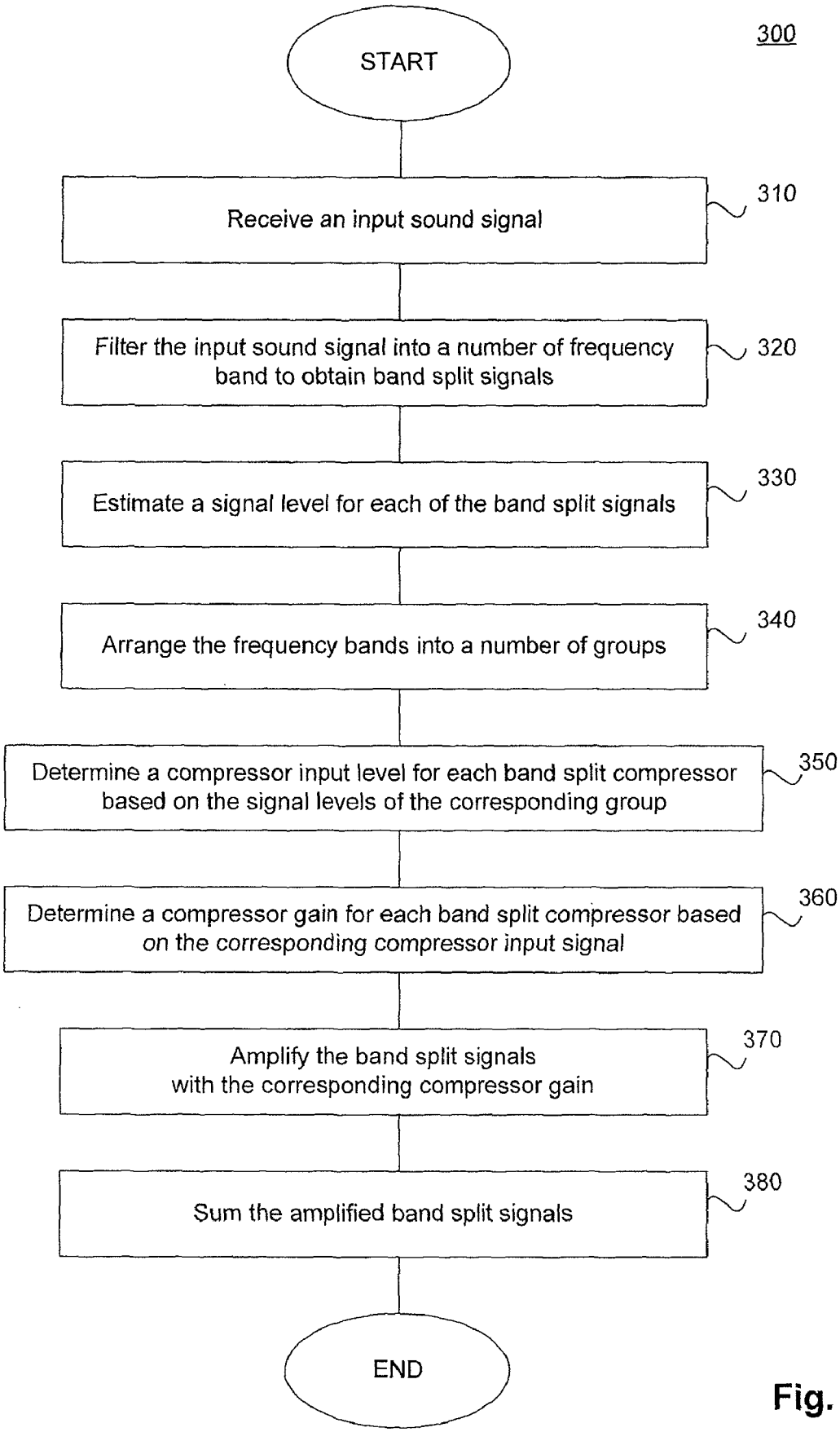
FIG. 3 is a flow diagram of a method according to one embodiment of the present invention.

FIG. 3 shows a flow diagram 300 of sound signal processing by efficient control of multi-band or band split compressors according to one embodiment of the invention. The sound signal processing is, according to an embodiment, performed by a hearing aid device such as the hearing aid 200 illustrated in FIG. 2.

In method step 310 of sound signal processing 300 an input sound signal is initially received and in step 320 filtered into a number of frequency bands to obtain band split signals. The input sound signal is thus divided into various frequency intervals which are advantageously adjacent to each other and which make it possible to adjust each frequency band individually depending on the hearing loss in that particular frequency band. In a next step 330, a signal level for each of the band split signals is estimated. The estimation or determination of the signal level of a band split signal is produced by, e.g., a signal level estimator unit 210 of a hearing aid 200.

The frequency bands are then arranged into one or more groups in step 340. Arranging the frequency bands into a group means that the estimated signal levels of the frequency bands assigned to that group are taken into account when determining the compressor input level of that group. According to an embodiment, the arrangement of the frequency bands into one or more groups, i.e. which frequency band is assigned to which group, is done, for example, depending on the nature of the input sound signal or according to a preset.

In step 350, a compressor input level is determined for each band split compressor based on the signal levels of the bands of the respective group. The respective group means that group to which the band split compressor has been assigned for the purpose of determining the compressor input level. The determination is done, for example, by calculating the compressor input level based on the signal levels of bands in the group using a maximum, a minimum or a mean signal level, or even further appropriate mathematical functions. According to a particular embodiment, a frequency band may be associated with more than one group so that the signal level in that frequency band will be used to determine a plurality of compressor input levels, namely all those compressor input levels that are determined based on a group to which the signal level has been associated in step 340. As a result, an individual compressor input level for each frequency band, e.g. a compressor input level 220-1 for frequency band 1 is calculated not only based on the respective signal level, e.g. 218-1 of the respective frequency band, but also on all signal levels of the group to which frequency band has been assigned. In step 360 a compressor gain for each frequency band is then determined based on the corresponding compressor input level and initial gain values in accordance with the hearing loss of the hearing aid user. The individual compressor gain amounts for each frequency band are then used to amplify the respective band split signals in step 370. In a subsequent step 380 the amplified band split signals are summed to produce an electrical output sound signal.

Spectral smearing affecting the audibility and speech intelligibility can be avoided by arranging the frequency bands into groups and determining/calculating the respective compressor input level based on the signal levels of the respective group. The compressor input levels may then be used for determining the individual compressor gain for each of the band split compressors 204-1, 204-2, **204-*n***, since the calculation of the compressor gains are not solely based on the signal level in the respective frequency band. Therefore, the compressor gain amounts will not only be increased or decreased based on the signal level of the respective frequency band but also based on signal levels of other bands within the respective group. However, the gain amounts are still calculated individually meaning that for each band split compressor an individual compressor input level is determined so that e.g. different hearing losses in certain frequency ranges can still be handled by individual initial gain values in the band split compressors to get an overall satisfying gain adjustment.

The calculation of each of the compressor input levels based on the signal levels of bands within the group, according to an embodiment, is done by weighting the signal levels in the group. For example, the compressor input level is determined as a weighted average which means that at first the signal levels in the group are scaled according to the applied weighting function, and then a mathematical average on the scaled signal levels is performed to calculate a resulting compressor input level. According to a further embodiment, one group of signal levels is used to determine the compressor input levels for several band split compressors. All these compressor input levels resulting from that one group will then be set to the maximum level of the signal levels of this group implementing a so-called max function. It should be noted that other mathematical functions like min or mean functions may be implemented according to embodiments of the present invention.

According to an embodiment, the weighting of the signal levels of one group is done by the following calculation rule, wherein the sound signal is filtered into frequency bands 0, 1, . . . , n−1, n corresponding to band split compressors 204-1, . . . , 2004-*n*−1, 204-*n* and the calculation step comprises:

calculating the compressor input level 222-1 of compressor 204-1 by 0.5*signal level 220-1 of frequency band 1 plus 0.5*signal level 220-2 of frequency band 2;

calculating the compressor input levels 222-2, . . . , 222-*n*−1 of compressors 204-2, . . . 204-*n*−1 by 0.25*signal level 220-1, . . . , 2220-*n*-2 of frequency band 1, . . . , n−2 plus 0.5*signal level 220-2, . . . , 220-*n*−1 of frequency band 2, . . . , n−1 plus 0.25*signal level 220-3, . . . , 220-*n* of frequency band 3, . . . , n, respectively; and calculating the compressor input level 220-*n* of compressor 204-*n* by 0.5*signal level 220-*n*−1 of frequency band n−1 plus 0.5*signal level 220-*n* of frequency band n.

Such a weighting function may be an advantage since the actual signal level of the respective frequency band is still considered by a factor 0.5 while the neighbouring frequency bands are considered by a factor of 0.25 (or also 0.5 if there is only one neighbouring frequency band) when determining the input level for the compressor. Further weighting schemes may be implemented which not only consider the signal levels of neighbouring frequency bands but also further frequency bands adjacent to, in proximity of, or depending on the nature of the input sound, not in proximity of, the respective frequency band of which the input level for the band split compressor is then determined. A frequency band adjacent to, or in proximity of, another frequency band should be understood as a frequency band which is near another frequency band but not a neighbouring frequency band. It should also be noted that other weightings, mathematical or distribution functions, e.g. a normal distribution, could be used to calculate a compressor input level based on the signal levels of the group, wherein the distance or proximity of a frequency band to the frequency band of the present compressor input level determines the weighting of the signal levels. For example, and as a rule of thumb, the more distant a frequency band is from the frequency band of the calculated compressor input level the less weight is put to the signal level, e.g. by assigning a low weighting factor in the compressor input level calculation.

After the compressor input levels have been calculated in step 350, each band split compressor will determine an individual compressor gain for the respective single frequency band so that an individual gain according to the band split compressor is assigned to each frequency band and applied to individually amplify the respective band split signal. As a result, audibility and speech intelligibility can be increased since spectral differences in the speech spectrum can be maintained and are not smoothed out or smeared due to the controlled but still individual gain adjustments.

Figure 4:
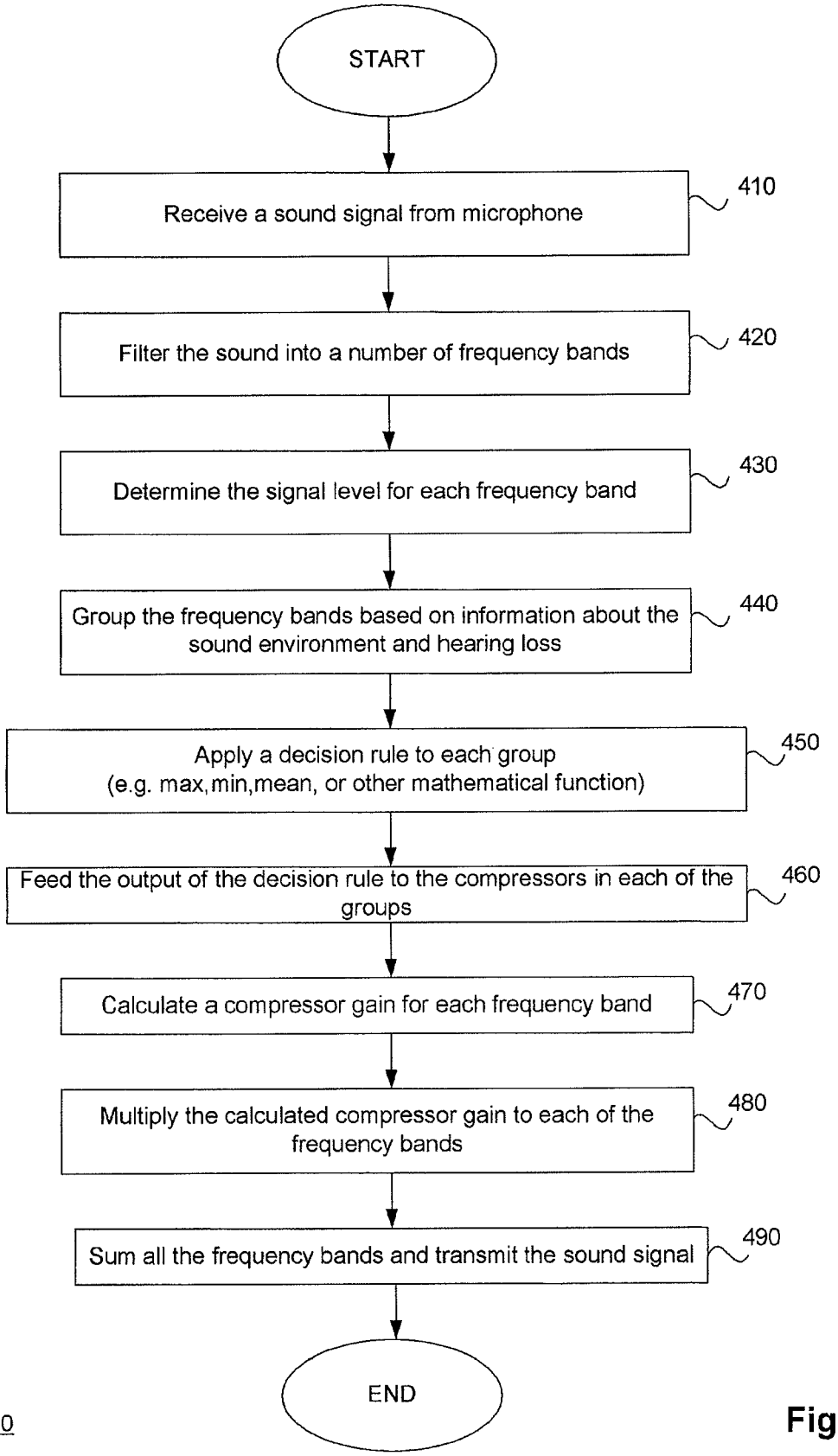
FIG. 4 is a flow diagram of a method according to another embodiment of the present invention.
Figure 5:
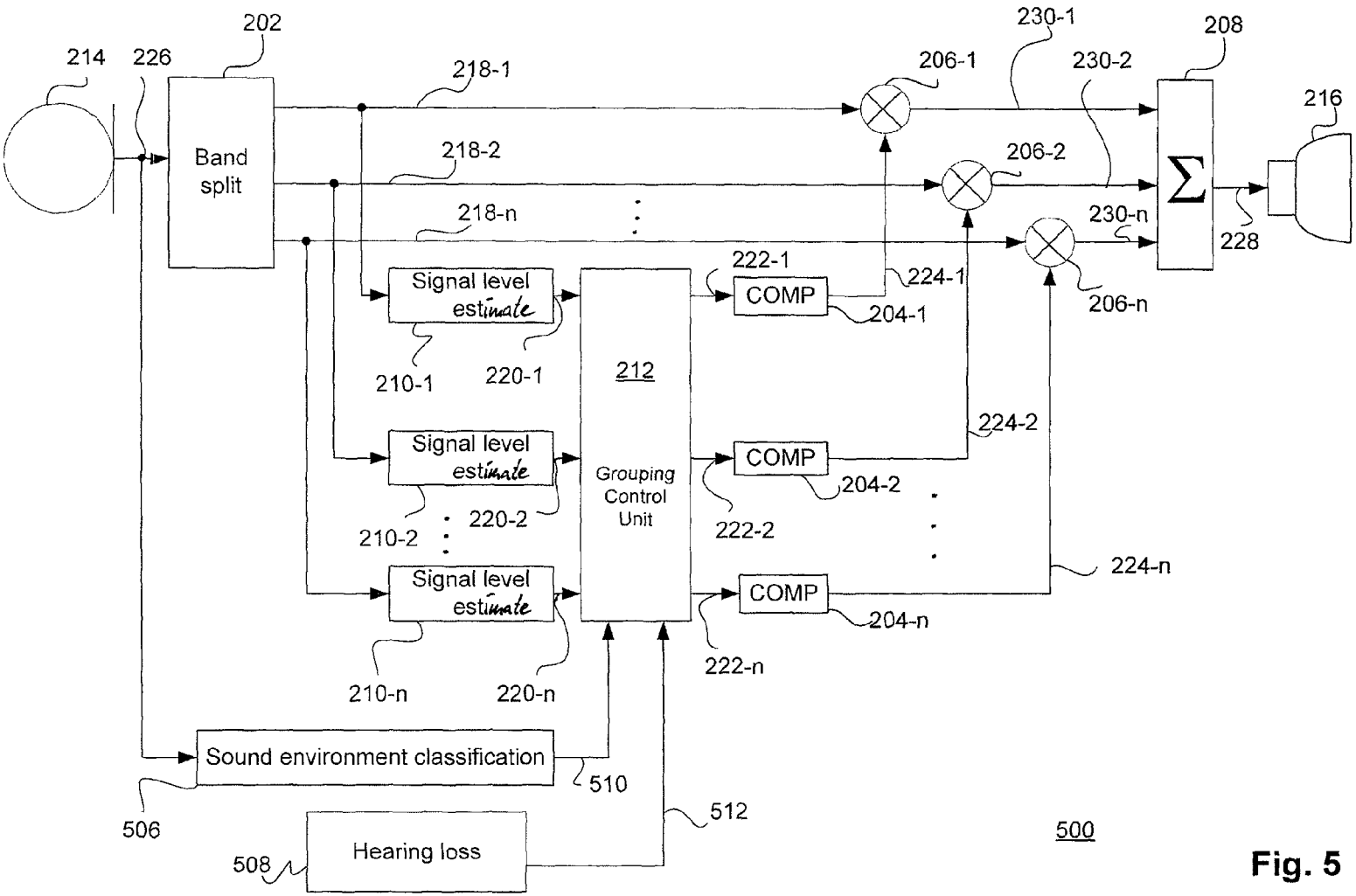
FIG. 5 is a block diagram of a hearing aid according to another embodiment of the present invention.
Figure 6:
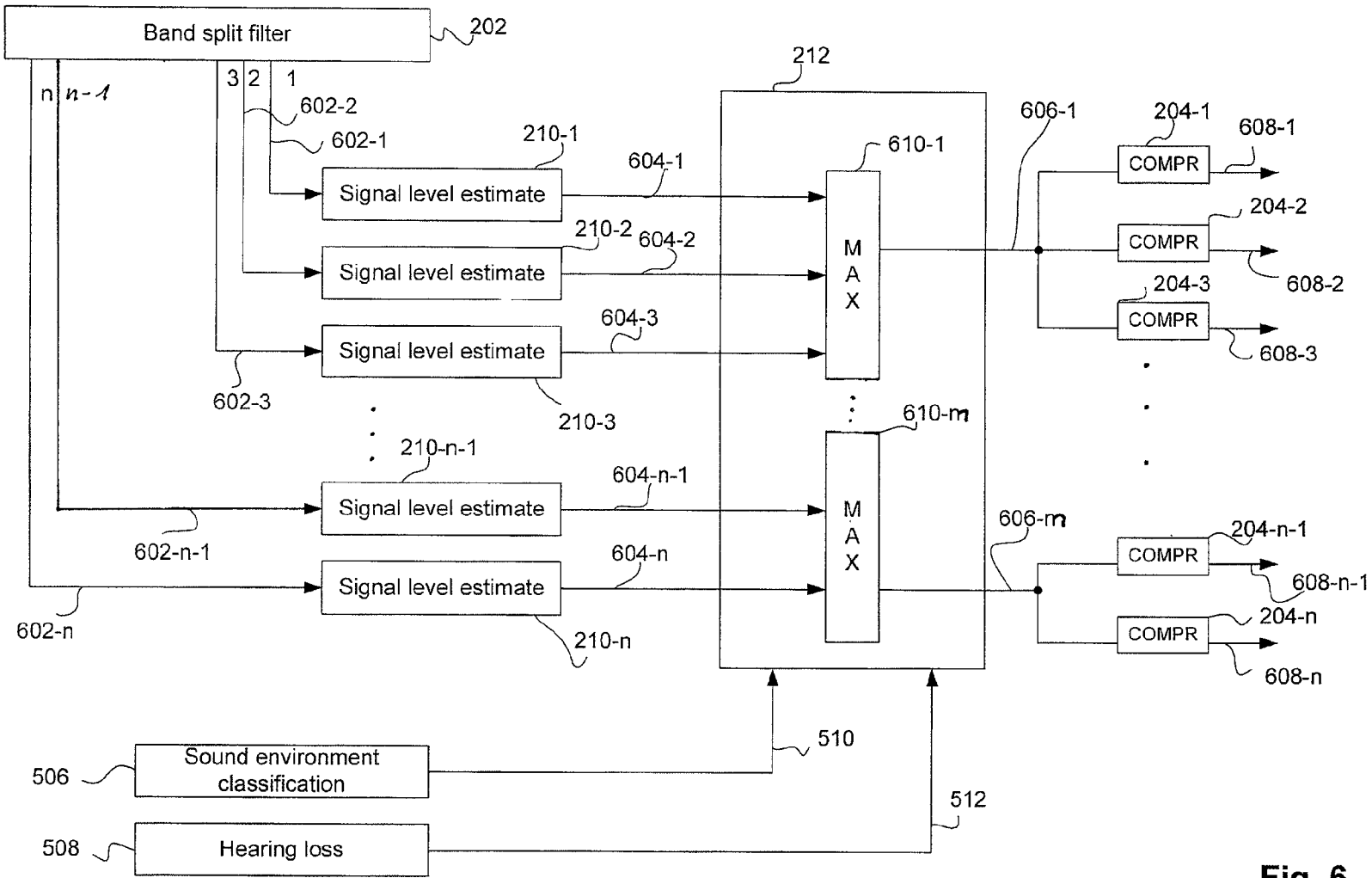
FIG. 6 is a representative block diagram of functional units for use in a hearing aid according to an embodiment of the present invention.

FIG. 4 is a flow diagram of an alternative embodiment of a method 400 which may be performed by hearing aids according to other embodiments of the present invention such as illustrated in FIGS. 5 and 6.

Similar to the method illustrated in FIG. 3, the sound signal processing 400 initially receives a sound signal from a microphone (step 410), filters the sound into a number of frequency bands (step 420), and determines the signal level for each frequency band (step 430). In step 440, the frequency bands are then grouped based on information about the sound environment and/or the hearing loss. This grouping step may be done even before the actual sound signal processing and could therefore be placed elsewhere before step 450 in the flowchart 400, or even done separately. The sound environment may be classified by analysing the input sound signal and deriving a sound environment class according to typical sound environment situations as it is illustrated in FIGS. 5 and 6 by the sound environment classification unit 506.

Examples of typical sound environment situations serving as reference sound environment classes in which the current input sound signal can be classified, i.e. sound environment templates, may comprise, but are not limited to, the following sound environment situations: speech in quiet surroundings, speech in stationary, non-varying noise, speech in impulse-like noise, noise without speech, or music. After the input sound signal, or signals have been classified into one of the mentioned sound environment classes, the grouping of the frequency bands is derived from the classification result. For example, the frequency bands may be arranged in fewer groups in case of environments with noise thereby obtaining better comfort, while more groups may be an advantage for improving audibility and speech intelligibility in environments with speech and music.

If the grouping is (also) derived from the hearing loss, e.g., less frequency bands would be arranged in more groups for a sloping hearing loss with large differences between the degree of hearing loss in different frequency bands. On the other hand, fewer groups with more frequency bands per group may be an advantage for mild and flat hearing losses.

After the frequency bands have been grouped a decision rule is applied to each group in step 450. The decision rule may also be based on the sound environment classification and the degree of hearing loss, and may be implemented by a mathematical function, e.g. a max, min, or mean function as described above.

According to an embodiment the output of the decision rule is the compressor input level, which is fed to all band split compressors in the respective group, e.g. when a max function is applied according to the decision rule and the compressor input levels relating to that group are set equal to the maximum signal value in the group (step 460). The band split compressors then calculate the compressor gain in step 470 based on the input level and the initial gain function derived from the degree of hearing loss. The calculated compressor gain amount of the band split compressor is then multiplied with the band split signal of the respective frequency band (step 480). The sound signal processing is completed in step 490 by summing all the band split signals to produce an output sound signal.

FIG. 5 illustrates a hearing aid according to an embodiment of the invention similar to the one as described with respect to FIG. 2 that further comprises a sound environment classification unit 506 and a hearing loss unit 508. The sound environment classification unit 506 receives the input sound signal 226 from the input transducer 214 and classifies the sound environment based on the input sound signal as described in connection with method step 440. The classification result is then submitted to the grouping control unit 212 by a signal 510. Hearing loss unit 508 stores the degree of hearing loss of the hearing aid user. The degree of hearing loss is determined, e.g., in a hearing aid fitting session in which the hearing threshold level in each frequency band of the hearing aid user is measured. The degree of hearing loss is also submitted to the grouping control unit 212 by a signal 512 either at some point during the fitting session or during use of the hearing aid. Likewise the degree of hearing loss in each frequency band may also be submitted from hearing loss unit 508 to each respective band split compressor (not shown in FIG. 5) to be used to calculate the appropriate compressor gain amounts.

FIG. 6 illustrates a more detailed representation of a part of a hearing aid 500 according to an embodiment of the present invention. Each band split signal 602-1, 602-2, 602-3, . . . , **602-*n*−1, and 602-*n* is fed to a respective signal level estimate unit 210-1, 210-2, 210-3, 210-*n*−1, and 210-*n* to produce a respective signal level value 604-1, 604-2, 604-3, 604-*n*−1, and 604-*n*. The frequency bands have been arranged, e.g., in groups of three adjacent frequency bands, e.g. bands 1, 2, and 3 with a remaining group of two frequency bands n−1 and n according to the signals 510 and 512 from the sound environment classification unit 506 and from the hearing loss unit 508 to grouping control unit 212. The grouping control unit 212 comprises decision rule units 610-1 and 610-*m* to calculate the compressor input levels 606-1 and 606-*m*. In the embodiment as illustrated in FIG. 6, the decision rule units 610-1 . . . 610-*m* utilise a max function to calculate the compressor input levels 606-1 . . . , 606-*m*. The applied max function may be derived from the signals 510 and 512 submitted by the sound environment classification unit 506 and hearing loss unit 508, respectively. The signal levels 604-1, 604-2, and 604-3 arranged in group 1 are submitted to decision rule unit 610-1 to produce compressor input level 606-1 which is then supplied to the respective band split compressors 204-1, 204-2, and 204-3 of the respective frequency bands 1, 2, and 3 to produce individual compressor gain amounts 608-1, 608-2, and 608-3. Similarly, the signal levels of frequency bands n−1 and n, which are arranged in group m, are submitted to decision rule unit 610-*m* applying the max function which means that always the maximum signal level of signal levels 604-*n*−1 and 604-*n* is selected and fed as the compressor input level 606-*m* to the respective band split compressors 204-*n*−1 and 204-*n* to produce compressor gain amounts 608-*n*−1 and 608-*n*** which are then used to amplify the respective band split signals.

According to another embodiment, for each band split compressor a separate group of respective frequency bands will be arranged so that each band split compressor 204-1, . . . , **204-*n* is supplied with an individual compressor input level 2221, . . . , 222-*n***.

Figure 7:
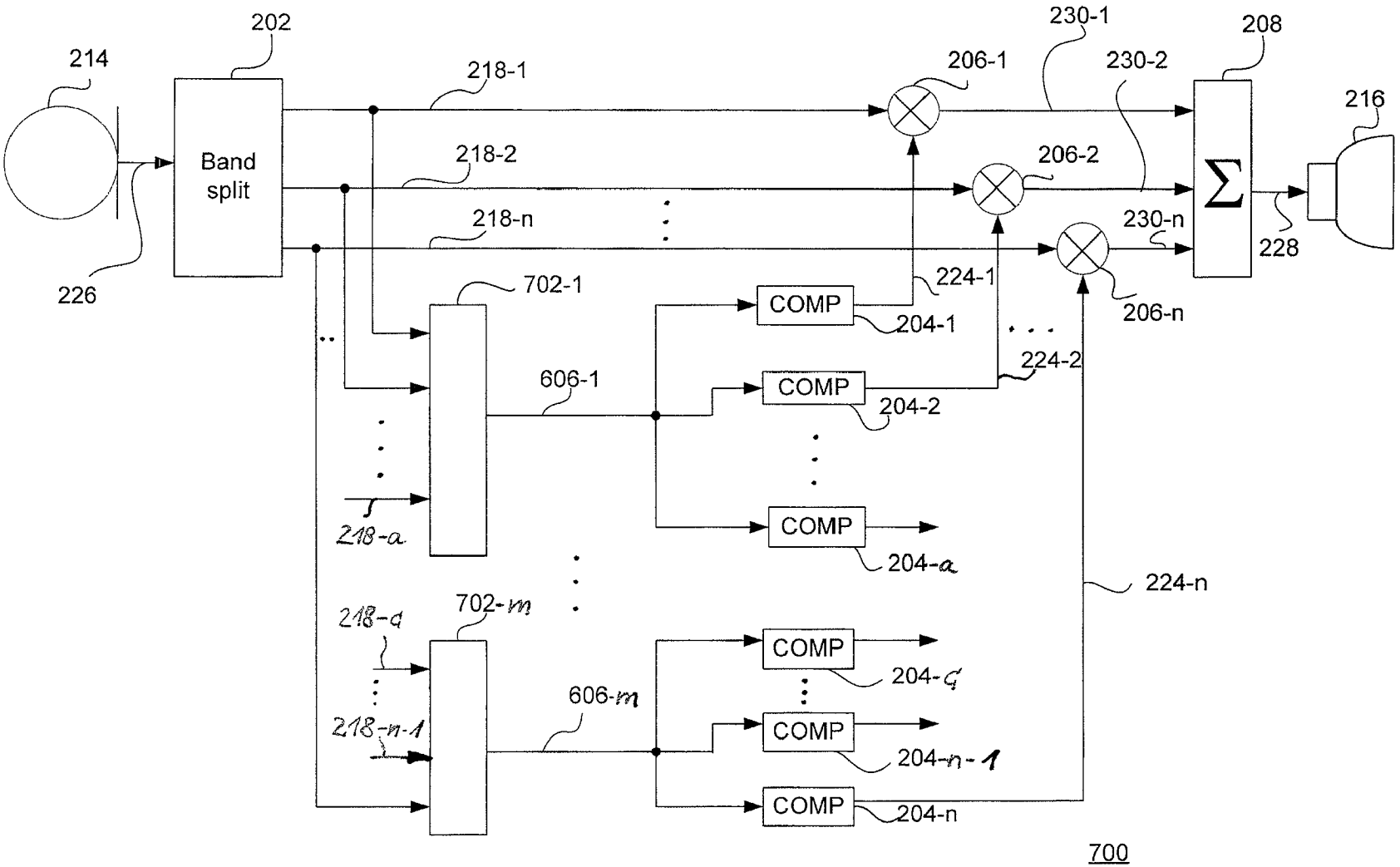
FIG. 7 is a block diagram of a hearing aid according to still another embodiment of the present invention.

FIG. 7 illustrates a further embodiment according to the present invention, which is simplified but still takes advantage of one or more of the principles of the present invention. The hearing aid 700 in FIG. 7 dispenses with the estimation of the signal level for each frequency band. The compressor input levels 606-1, . . . , and **606-*m* are rather determined by decision rule units 702-1, . . . , and 702-*m* directly from band split signals 218-1, . . . , 218-*n*. The hearing aid 700 comprises at least two of these decision rule units 702-1 and 702-*m* (in this case m>=2) for each group of frequency bands 1, . . . m. Those of the band split signals 218-1, . . . , 218-*n* that are assigned the group 1 are supplied to the decision rule unit 702-1. The decision rule unit 702-1 then processes the supplied band split signals 218-1, 218-2, . . . , 218-*a* to respective signal levels and applies a mathematical function to the signal levels as already described herein to determine a compressor input level 1, 606-1 for band split compressors 204-1, 204-2 . . . , 204-*a* as exemplary illustrated in FIG. 7. Accordingly, decision rule unit 702-*m* determines a common compressor input level value 606-*m* for band split compressors 204-*c*, 204-*n*−1, 204-*n*, based on band split signals 218-*c* . . . , 218-*n*1, 218-*n*. The embodiment as illustrated in FIG. 7** may in particular be appropriate in a dedicated sound environment, e.g., speech in almost quiet surroundings, so that the grouping can be fixed before hand only based on the degree of hearing loss and the expected input speech signals.

Preferred embodiments of the present invention distinguish themselves by providing a single band split compressor for each frequency band which is controlled not only by the signal level of the respective frequency band but also by further appropriate signal levels of e.g. adjacent frequency bands. The fact that the control of the band split compressors is performed before the actual compression may be further regarded as an advantage of the present invention since the full range of gain may thus be kept.

Further advantages of the present invention may be seen by the implementation of hearing aids according to the embodiments described with reference to the present invention which require less hardware and have a low power consumption. Last but not least, depending on the decision rule, the control mechanism according to the present invention may always be active independently whether a certain threshold has been exceeded or not.

According to preferred embodiments of the present invention, methods, systems and hearing aid devices described herein are implemented on signal processing devices suitable for the same, such as, e.g., digital signal processors, analogue/digital signal processing systems including field programmable gate arrays (FPGA), standard processors, or application specific signal processors (ASSP or ASIC).

According to a further embodiment, the invention is implemented in a computer program containing executable program code. The program code may be stored in a memory of a digital hearing device or a computer memory and executed by the hearing aid device itself or a processing unit like a CPU thereof or by any other suitable processor or a computer executing a method according to the described embodiments. The computer program my be embodied by a computer program product like a floppy disk, a CD-ROM, a memory stick or any other suitable memory medium for storing program code.

All appropriate combinations of features described above are to be considered as belonging to the invention, even if they have not been explicitly described in their combination.

Having described and illustrated their principles of the present invention in embodiments thereof, it should be apparent to those skilled in the art that the present invention may be modified in arrangement and detail without departing from such principles. Changes and modifications within the scope of the present invention may be made without departing from the spirit thereof, and the present invention includes all such changes and modifications.

We claim:

1. A method for processing sound signals in a hearing aid, said method comprising:

a. filtering an input sound signal into a number of frequency bands to obtain band split signals;

b. estimating a signal level for each of the band split signals;

c. arranging the frequency bands in at least two groups, wherein at least one group comprises signal levels of at least two frequency bands;

d. calculating a compressor input level for each band split signal, wherein the compressor input level for a respective band split signal is calculated based on the signal levels of the frequency bands of the group associated with said respective band split signal;

e. determining a compressor gain for each band split signal based on the respective compressor input level; and f. amplifying each band split signal with the determined compressor gain for said respective band split signal.

2. The method according to claim 1, wherein said groups are arranged based on the nature of the input sound signal and the degree of hearing loss of a hearing impaired person.

3. The method according to claim 2, wherein the step c) comprises:

determining the nature of the input sound signal by classifying the input sound signals into sound classes; and selecting a grouping template according to the determined sound class.

4. The method according to claim 3 comprising:

determining the nature of the input sound signal by classifying the input sound signals into sound classes; and providing a decision rule according to the determined sound class.

5. The method according to claim 3 comprising:

providing the degree of hearing loss;

classifying provided degrees of hearing losses into hearing loss classes; and providing a decision rule according to the determined hearing loss class.

6. The method according to claim 2, wherein the step c) comprises:

providing the degree of hearing loss;

classifying provided degrees of hearing loss into hearing loss classes; and selecting a grouping template according to the determined hearing loss class.

7. The method according to claim 1, wherein each group comprises at least two neighbouring frequency bands.

8. The method according to claim 1 wherein step d) comprises controlling the compressor input level by weighting the signal levels in the group.

9. The method according to claim 1, wherein the step of filtering an input signal comprises filtering the sound signal into frequency bands 1, . . . , n−1, n corresponding to band split compressors 1, . . . , n−1, n, and said step of calculating said compressor input levels comprises:

calculating the compressor input level of compressor 1 by 0.5*signal level of frequency band plus 0.5*signal level of frequency band 2;

calculating the compressor input levels of compressors 2, . . . , n−1 respectively by 0.25*signal level of frequency band 1, . . . , n−2 plus 0.5*signal level of frequency band 2, . . . , n−1 plus 0.25*signal level of frequency band 3, . . . , n; and calculating the compressor input level of compressor n by 0.5*signal level of frequency band n−1 plus 0.5*signal level of frequency band n.

10. The method according to claim 1, wherein the step of calculating said compressor input level comprises:

d1) determining a decision rule for each group; and d2) applying the decision rule to the signal levels of the frequency bands belonging to the group.

11. The method according to claim 6, wherein said decision rule is a mathematical function selected from a set comprising max, min, or mean function assigning the maximum, minimum, or mean signal level of the signal levels in the group as the compressor input level.

12. A hearing aid, comprising:

an input transducer which is configured to transform an acoustic input sound signal into an electric input sound signal;

a band split filter unit which is configured to filter the electric input sound signal into a number of frequency bands thereby obtaining a set of band split signals;

a signal level estimation unit which is configured to determine a signal level for each of the band split signals;

a grouping control unit which is configured to allocate the frequency bands into at least two groups, wherein at least one group comprises signal levels of at least two frequency bands, and to calculate a compressor input parameter for each band split compressor, wherein the compressor input parameter for at respective band split compressor is calculated based on the signal levels of the frequency bands of the group associated with said respective band split compressor;

a band split compressor for each frequency band which is configured to determine a compressor gain based on the respective compressor input parameter, and to amplify each of the band split signals according to the compressor gain determined by the respective band split compressor;

a summing unit which is configured to sum the amplified band split signals to an electric output signal; and an output transducer which is configured to transform the electric output signal into an acoustic output signal.

13. The hearing aid according to claim 12, wherein the grouping control unit is further configured to weight the signal levels in each group to calculate the compressor input parameters.

14. The hearing aid according to claim 12, wherein said band split filter unit is further configured to filter the electric input sound signal into frequency bands 1, . . . , n−1, n corresponding to band split compressors 1, . . . , n−1, n, and the grouping control unit is further configured so that:

the compressor input parameter of compressor 1 is calculated by 0.5*signal level of frequency band 1 plus 0.5*signal level of frequency band 2;

the compressor input parameter of compressors 2, . . . , n−1 is calculated by 0.25*signal level of frequency band 1, . . . , n−2 plus 0.5*signal level of frequency band 2, . . . , n−1 plus 0.25*signal level of frequency band 3, . . . , n; and the compressor input parameter of compressor n is calculated by 0.5*signal level of frequency band n−1 plus 0.5*signal level of frequency band n.

15. The hearing aid according to claim 12, wherein said grouping control unit is further configured to determine a decision rule for each group, and to apply the decision rule to the signal levels of the frequency bands belonging to the group.

16. The hearing aid according to claim 15, wherein said grouping control unit comprises a function unit implementing the decision rule as a mathematical function selected from a set containing a maximum, a minimum or a mean function, and applied to the signal levels in each group as the compressor input parameters for the band split compressors of the frequency bands of each group.

17. The hearing aid according to claim 12, comprising a sound environment classification unit which is configured to determine a nature of the input sound signal by classifying the input sound signals into sound classes, and to provide to the grouping control unit a grouping template according to the determined sound class.

18. The hearing aid according to claim 17, wherein the sound environment classification unit is further configured to provide to the grouping control unit a decision rule according to the determined sound class.

19. The hearing aid according to claim 17, wherein the hearing loss unit is further configured to provide to the grouping control unit a decision rule according to the determined hearing loss class.

20. The hearing aid according to claim 12, comprising a hearing loss unit which is configured to evaluate the degree of hearing loss of a hearing impaired person, to classify provided degrees of hearing loss into hearing loss classes, and to provide to the grouping control unit with a grouping template according to the determined hearing loss class.

* * * * *